US009930954B2

(12) United States Patent
Smith

(10) Patent No.: US 9,930,954 B2
(45) Date of Patent: Apr. 3, 2018

(54) DISPENSERS FOR VISCOUS OR PASTY MATERIALS

(71) Applicant: Carbonite Corporation, Panama City (PA)

(72) Inventor: Matthew Eric Smith, Isle of Man (GB)

(73) Assignee: Carbonite Corporation, Panama City (PA)

( * ) Notice: Subject to any disclaimer, the term of this patent is extended or adjusted under 35 U.S.C. 154(b) by 0 days.

(21) Appl. No.: 15/119,272

(22) PCT Filed: Jan. 26, 2015

(86) PCT No.: PCT/GB2015/050170
§ 371 (c)(1),
(2) Date: Aug. 16, 2016

(87) PCT Pub. No.: WO2015/121612
PCT Pub. Date: Aug. 20, 2015

(65) Prior Publication Data

US 2017/0007005 A1 Jan. 12, 2017

(30) Foreign Application Priority Data

Feb. 17, 2014 (GB) ..... 1402765.0

(51) Int. Cl.
*A45D 40/26* (2006.01)
*B65D 47/44* (2006.01)
(Continued)

(52) U.S. Cl.
CPC ..... *A45D 40/26* (2013.01); *B65D 35/08* (2013.01); *B65D 35/36* (2013.01); *B65D 35/46* (2013.01); *B65D 47/44* (2013.01)

(58) Field of Classification Search
CPC ..... A45D 40/26; A45D 34/041; B65D 35/08; B65D 35/36; B65D 35/46; B65D 47/44;
(Continued)

(56) References Cited

U.S. PATENT DOCUMENTS 1,296,884 A 3/1919 Volk
1,739,871 A 11/1926 Smith
(Continued)

FOREIGN PATENT DOCUMENTS

DE 3526109 A1 1/1987
DE 29907933 U1 9/1999
(Continued)

OTHER PUBLICATIONS

"Search Report" issued in counterpart Great Britain Patent Application No. GB1402765.0, dated Aug. 14, 2014, Published in: GB.
(Continued)

*Primary Examiner* — Nicholas J Weiss
(74) *Attorney, Agent, or Firm* — Kaplan Breyer Schwarz, LLP

(57) ABSTRACT

A dispenser for viscous or pasty materials comprises a storage container in the form of a flexible tube (2) and an applicator (24). The tube (2) comprises an elongate, 1-piece hollow moulding of polymeric material, one end of which is closed and formed at the other end of which is an integral dispensing valve defining one or more dispensing slits (22). The or each dispensing slit is defined by a respective pair of resilient plates (18), which are opposed and inclined to one another and have a respective free edge, the two free edges defining a dispensing slit. The applicator has an applicator surface and one or more passages (30), into which the free edges of a respective pair of resilient plates is received. The width of each passage in the applicator is dimensioned such that there is a gap between the free edges of the resilient
(Continued)

plates and the associated side surfaces of the passage, when the dispensing slit is closed and so that this gap is substantially closed, when the dispensing slit is opened by the application of pressure to the flexible tube in order to dispense material within the tube.

11 Claims, 4 Drawing Sheets

(51) Int. Cl.
*B65D 35/46* (2006.01)
*B65D 35/08* (2006.01)
*B65D 35/36* (2006.01)

(58) Field of Classification Search
CPC ... B05C 17/00; B05C 17/12; B05C 17/00503; B05C 17/00583
See application file for complete search history.

(56) References Cited

U.S. PATENT DOCUMENTS 2,283,463 A * 5/1942 Rupp ..... B65D 35/36 222/494
2,605,026 A * 7/1952 Wagner ..... B65D 47/2037 222/490
2,670,884 A * 3/1954 Swartz ..... B65D 47/2031 222/490
3,521,795 A * 7/1970 Bergishagen ..... B65D 35/30 222/386
3,773,233 A 11/1973 Souza
4,230,240 A * 10/1980 Laauwe ..... B65D 47/2081 222/212
4,524,805 A * 6/1985 Hoffman ..... F16K 15/147 137/846
4,739,906 A * 4/1988 Loturco ..... A61J 1/1443 222/212
5,743,441 A * 4/1998 Baudin ..... A45D 34/04 222/206
6,062,436 A * 5/2000 Fuchs ..... B65D 47/2031 137/846
6,536,631 B1 * 3/2003 Nickels ..... B65D 47/2018 222/212
7,037,303 B2 * 5/2006 Beaufore ..... A61F 2/0013 137/849
7,086,572 B2 * 8/2006 Socier ..... B65D 47/2031 222/212
7,314,328 B2 * 1/2008 Liberatore ..... B05C 17/00506 222/566
7,695,210 B1 4/2010 Martinez
8,328,450 B2 * 12/2012 Smith ..... A45D 34/041 222/494
8,814,010 B2 * 8/2014 Romanov ..... B05B 1/042 222/490
9,073,248 B2 * 7/2015 Smith ..... B29C 45/0046
9,376,241 B2 * 6/2016 Heipp ..... B65D 47/2031
2002/0125272 A1 * 9/2002 Sekendur ..... B65D 35/46 222/490
2005/0135869 A1 6/2005 Liberatore
2010/0303535 A1 12/2010 Smith

FOREIGN PATENT DOCUMENTS

WO 2010016478 A1 2/2010
WO 2013014412 A1 1/2013

OTHER PUBLICATIONS

Authorized Officer: Jacques Fournier, "International Search Report and Written Opinion" issued in counterpart International Patent Application No. PCT/GB2015/050170, dated Apr. 2, 2015, Publisher: PCT.

* cited by examiner

DISPENSERS FOR VISCOUS OR PASTY MATERIALS

CROSS REFERENCE TO RELATED APPLICATIONS

This application is a national phase of PCT International Application No. PCT/GB2015/050170, filed Jan. 26, 2015, which claims priority to GB patent application No. 1402765.0, filed Feb. 17, 2014, which is incorporated herein by reference.

The present invention relates to dispensers for flowable material e.g. in the form of a viscous liquid, a paste, a gel or the like. The invention is particularly, though not exclusively, concerned with dispensers for toiletry preparations, particularly antiperspirant and/or deodorant preparations.

Antiperspirant and deodorant preparations are commonly provided in the form of a viscous liquid in a small bottle or other container, formed in the throat of which is a part-cylindrical seat. Retained in a captive but rotatable manner within this seat is a spherical ball, the upper portion of which is exposed to the atmosphere, after any protective cap has been removed, and the lower portion of which is exposed to the interior of the container. In order to apply the liquid to the skin of a user, the container is inverted and the surface of the ball is placed in contact with the skin of the user and moved laterally. This movement causes the ball to rotate in its seat and the portion of the surface of the ball exposed to the interior of the casing is coated with a thin layer of the liquid and is then moved to the exterior of the container and contacts the skin of the user and thus deposits the layer of liquid on the skin. Whilst such dispensers are very effective, it is complex and expensive to manufacture them, particularly as they consist of at least three different components, namely the container, the seat and the ball, which must be connected together after the container has been filled with the liquid. The necessity of separately manufacturing these components and then subsequently connecting them means that the known antiperspirant/deodorant dispenser is extremely expensive.

WO 2013/014412 discloses a method of injection moulding a dispensing valve of slit valve type in which the slit is created during the moulding process whereby the entire valve may be made in a single manufacturing step and there is no need to form the slit in a separate step subsequent to the moulding process.

It is the object of the present invention to provide a dispenser for viscous or pasty materials which is both simpler and cheaper to manufacture than known dispensers.

According to a first aspect of the present invention, there is provided a dispenser for viscous or pasty materials comprising a storage container in the form of a flexible tube and an applicator, the flexible tube comprising an elongate, one-piece, hollow moulding of polymeric material, one end of which is closed and formed at the other end of which is an integral dispensing valve including a pair of resilient plates which are opposed and inclined to one another and have a respective free edge, the two free edges defining a single, linear dispensing slit, the applicator having an applicator surface and a single elongate passage formed in it in which the free ends of the resilient plates are received, the width of the single elongate passage being less at the ends of the passage than at the centre of the passage, whereby the application of pressure to the wall of the tube results in the free edges of the resilient plates moving apart to open the single dispensing slit and substantially abutt the side surfaces of the passage and, in use, in dispensing of a material through the dispensing slit onto the applicator surface.

It is preferred that the dispensing valve has two ends, the dispensing slit being formed at one of the ends and the other end being of generally oval tubular shape and communicating with the interior of the flexible tube.

According to a further aspect of the present invention there is provided a dispenser for viscous or pasty materials comprising a storage container in the form of a flexible tube and an applicator, the flexible tube comprising an elongate, one-piece, hollow moulding of polymeric material, one end of which is closed and formed at the other end of which is an integral dispensing valve including two or more pairs of opposed resilient plates inclined to one another, the plates of each pair having respective free edges, the two free edges of each pair defining a linear dispensing slit, the two or more dispensing slits being inclined to one another, the applicator having an applicator surface and two or more elongate passages formed in it which communicate with one another at one end, each elongate passage accommodating the free ends of a respective pair of resilient plates, wherein the width of each elongate passage is greater at the said one end than at the other end, whereby the application of pressure to the wall of the tube results in the free edges of each pair of dispensing slits moving apart to open the dispensing slits and substantially abutting the side surfaces of the associated passage and, in use, in the dispensing of a material through the dispensing slits onto the applicator surface.

It is preferred that the dispensing valve in accordance with this aspect of the invention has two ends, the dispensing slits being formed at one of the ends, the other end comprising a number of part-oval shaped tubular portions, each associated with a respective one of the dispensing slits, the part-oval shaped portions merging into one another, whereby the other end of the dispensing valve is of multilobal tubular shape.

Thus the dispenser in accordance with the invention comprises only two components, namely the tube and dispensing valve, which are made as a single unit by injection moulding, and the applicator, which may be connected to the tube in any desired manner. The tube is made in the form of a simple thin-walled cylinder which is open at one end and which is closed at the other end by an end wall which is integral with one end of the cylinder and formed in which is a slit valve. The cylinder, end wall and slit valve are made in a single moulding process method as disclosed in WO 2013/014412. The tube is then filled with the desired viscous or pasty material through the open end of the cylinder and the open end is then closed and sealed in any conventional manner, e.g. by pressing two adjacent sides of the open cylindrical wall together, folding them over once or twice and fastening them together, e.g. by adhesive or hot plate welding. The applicator is then connected to the tube, conveniently by a snap connection. In a preferred embodiment, the tube carries a first hollow boss extending around the dispensing valve and the applicator carries a second hollow boss projecting from its surface opposite to the applicator surface, the first and second bosses carrying cooperating formations, whereby the second boss may be pushed around or within the first boss and the cooperating formations interact to lock the applicator to the tube.

In the dispenser in accordance with the first aspect of the present invention, it is preferred that the width of the single passage in the applicator transverse to its length is substantially equal to the width of the two resilient plates at their free edges at the two ends of the passage and progressively increases towards the longitudinal centre of the passage. This means that when the valve is closed, there is a small gap between the outer surface of each of the resilient plates and the adjacent side surface of the passage. However, when a pressure is applied by the user to the wall of the flexible tube, the free edges of the two resilient plates move apart to open the slit to permit the contents of the flexible tube to be dispensed. This movement is at a maximum at the mid-point of the free edges and the gap is shaped and has dimensions such that the movement that occurs is sufficient to substantially close this gap.

In the dispenser in accordance with the second aspect of the present invention, there may be three, four or even more pairs of resilient plates and a corresponding number of dispensing slits and elongate passages in the applicator. The side surfaces of each dispensing plate will of course be integral with the side surfaces of the respective adjacent resilient plates of the adjacent pairs of resilient plates. Thus when there are three or more pairs of resilient plates as referred to above within respective passages in the applicator which communicate with another at one end, the resilient plates of each pair are connected together only at the outer ends of their free edges and the gaps between the resilient plates and the side surfaces of the associated passages will need to be differently dimensioned to permit unimpeded opening of the dispensing slits and to ensure substantial sealing of the elongate passages in the applicator, when the dispensing slits are open. For this reason, the width of each passage is at a minimum at its outer end, that is to say substantially equal to the combined thickness of the two resilient plates within it, and increases progressively to a maximum at the inner ends, which communicate with one another.

In the dispensers in accordance with both aspects of the present invention, it is preferred that the free edges of the or each pair resilient plates are substantially flush with or set back from the adjacent portions of the applicator surface. If the free edges are set back or recessed with respect of the adjacent portions of the applicator surface, it is preferred that this is by a distance less than the thickness of the applicator such that the or each dispensing slit is situated within the associated passage within the applicator.

It is preferred that the applicator is connected to the tube by a snap connection. This may be achieved in a number of different ways but in the preferred embodiment the tube carries a first hollow boss extending around the dispensing valve and the applicator carries a second hollow boss projecting from its surface opposite to the applicator surface, the first and second bosses carrying cooperating formations, whereby the second boss may be pushed around or within the first boss and the cooperating formations interact to lock the applicator to the tube.

If the dispenser is intended for storing and dispensing a deodorant or other toiletry preparation, it is preferred for reasons of personal comfort that the applicator surface is domed, that is to say is of part-spherical shape or at least arcuate in all planes. However, this is not essential and if the dispenser is intended, for instance, for dispensing a shoe cleaning preparation, the applicator surface may be substantially flat and in this event a layer of sponge or other resilient material may be attached to the applicator surface, in which event it will be the outer surface of the sponge or the like which will contact the surface to which the preparation is to be applied.

Further features and details of the invention will be apparent from the following description of two specific embodiments of dispenser for a deodorant preparation in accordance with the invention, which is given by way of example only and with reference to the accompanying drawings, in which.

Figure 1:
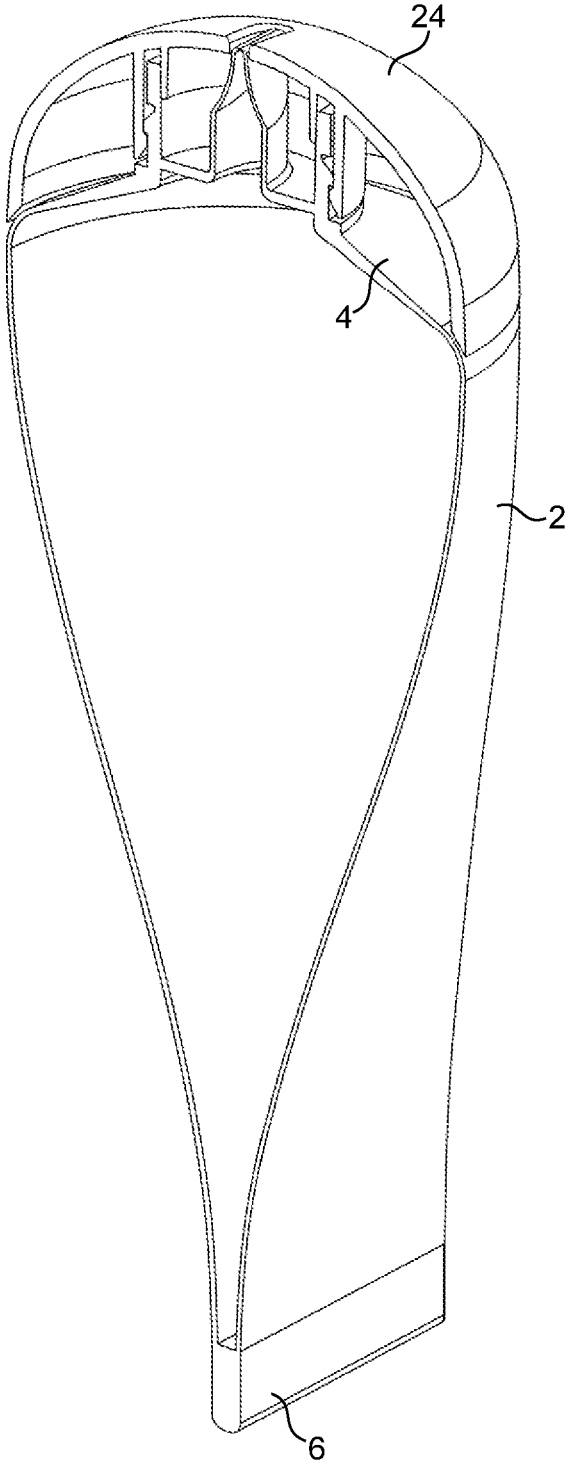
FIG. 1 is a partly cut away perspective view of a first embodiment of dispenser.
Figure 2:
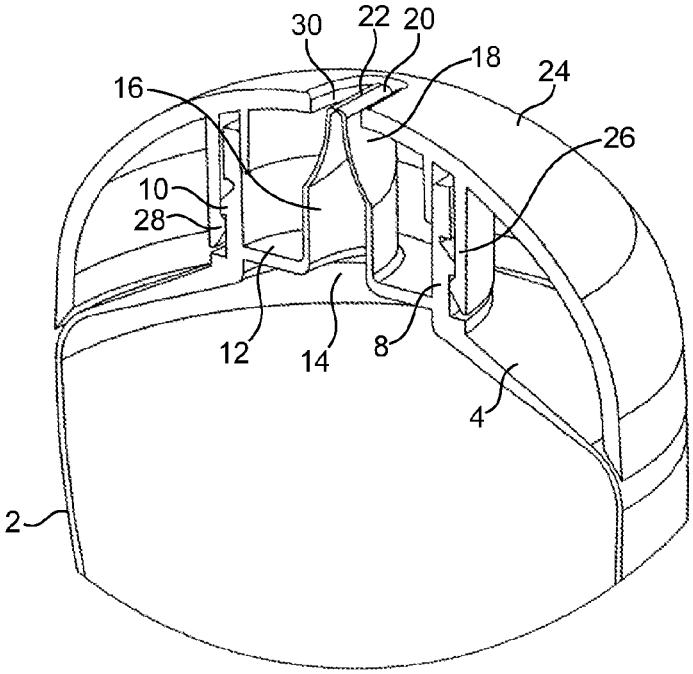
FIG. 2 is a partly cut away view of the upper portion only of the dispenser shown in FIG. 1.
Figure 3:
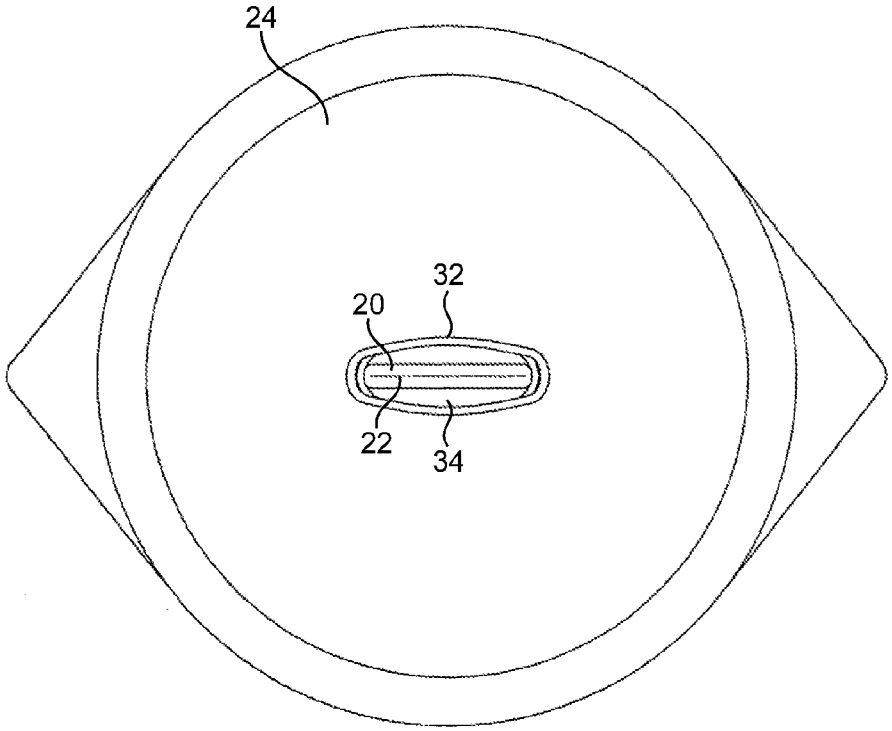
FIG. 3 is a plan view of the dispenser shown in FIG. 1.

Referring firstly to FIGS. 1 to 3, the dispenser consists of only two components, the first being a flexible tube with an integral dispensing valve and the second being an applicator. The flexible tube is initially made, e.g. by injection moulding, with a generally cylindrical side wall 2, one end of the cylinder being closed by an integral top wall 4. The other end of the cylinder is sealed, after the tube has been filled with the material to be dispensed, in any manner known per se, such as hot plate welding or adhesive, optionally after having pressed the two sides of the cylinder together and optionally rolling them up through one or two revolutions, to form a closed lower end 6. Integrally upstanding from the upper surface of the top wall 4 and coaxial with the axis of the cylinder is a connecting boss 8, on whose outer surface are one or more peripheral snap connection ribs 10. The lower end of the boss 8 is closed by an integral base 12, formed centrally in which is an oval or elliptical opening 14. Integral with the margin of the elliptical opening 14 is an upstanding tubular portion 16, at least the lower portion of which is therefore of matching elliptical shape. The upper end of the elliptical tubular portion 16 merges into and is integral with two generally flat, resilient plates 18, which are inclined towards one another in the upward direction. Each side surface of each inclined plate 18 merges into and is integral with an associated side surface of the other plate 18. The two inclined plates 18 have a free upper edge 20 and the two free edges 20 abut one another and define between them a dispensing slit 22. The elliptical tubular portion 16, the inclined plates 18 and the dispensing slit 22 together form a dispensing valve of generally duckbill type.

All the components referred to in the preceding paragraph constitute a one-piece injection moulded component made by a method as described in WO 2013/014412, to which reference may be made for further details. Crucially, however, one of the male and female injection mould halves carries a formation which defines a linear apex and when the male mould member is inserted into the female mould member, the linear apex is spaced from the opposing surface of the other mould member by a distance of between 0.0075 and 0.075 mm. When molten plastic material, typically an olefin material, such as polypropylene, is injected into the mould cavity defined by the mould members, the very small width of the gap defined between the linear apex and the opposing mould surface results in the flowing plastic material advancing into the gap from both sides and partially solidifying as it does so, whereby the two advancing fronts of molten plastic material meet along a line adjacent the linear apex but do not fuse together, whereby a linear discontinuity or dispensing slit is formed during the moulding process.

The applicator comprises a domed shell 24 of generally hemispherical shape, the diameter of which is equal to the diameter of the upper portion of the tube 2 and the diameter of the top wall 4. Depending integrally from the lower surface of the applicator 24 and coaxial with it and with the upper portion of the tube 2 is a further connecting boss 26, the internal diameter of which is substantially equal to the outer diameter of the upstanding connecting boss 8. Formed on the internal surface of the depending boss 26 is an annular snap connection bead or rib 28. The applicator 24 and the depending boss 26 are also injection moulded, e.g. from polyolefin material, such as polypropylene, and the boss 26 is therefore somewhat resilient. In order to connect the applicator to the tube, the applicator is moved downwardly with the depending connecting boss 26 extending around the upstanding connecting boss 8 and when the rib 28 on the depending boss 26 contacts the connecting rib 10 on the upstanding boss 8, the boss 28 is deformed outwardly until the rib 28 slides over the rib 10. When the rib 28 is situated beneath the rib 10, the boss 26 returns to its original shape and the rib 28 is located beneath the rib 10, whereby the applicator is connected to the boss 8 and thus also to the tube 2.

Situated centrally in the applicator 24 is an elongate passage or slot 30, into which the free edges 20 of the resilient plates 18 extend. The components are so dimensioned that the dispensing slit 22 is recessed below the external surface of the applicator 24 by a distance less than the thickness of the shell constituting the applicator 24, whereby the dispensing slit 22 is situated within the passage or slot 30. As may be seen in FIGS. 2 and 3, the upper portion of the side wall of the passage 30 is beveled at 32. The width of the passage 30 is not constant along its length but increases slightly from one end towards the longitudinal centre of the passage 30 and then decreases towards the other end. The width of the two longitudinal gaps 34 which are thus defined between the outer surfaces of the inclined plates 18 and the surfaces defining the side wall of the passage 30 therefore increases from a minimal value at one end to a maximum value at the longitudinal centre of the passage and then decreases again to the same minimal value at the other end. The width of the gap 34 is shown somewhat exaggerated in FIG. 3, for the sake of clarity.

When no pressure is applied to the tube 2, the two upper edges 20 of the inclined plates 18 are in contact with one another, at least substantially, over at least a proportion of their area, whereby the dispensing slit 22 defined between them is substantially closed and thus forms a substantial seal, at least to viscous or pasty materials. However, if an external pressure is applied to the tube 2, the resulting increase in pressure within the tube and the dispensing valve acts on the internal surfaces of the inclined plates 18 and this pressure acts to move the two upper edges of the inclined plates apart, thereby resulting in opening of the dispensing slit 22. The free edges of the two plates are of course connected together at their ends and thus relative movement of the free edges is prevented at their ends but the resilience of the material of the inclined plates permits such relative movements transverse to their plane to an increasing extent with increasing distance from the ends, whereby the free edges move apart by the greatest amount at their longitudinal centre. The distance moved by the free edges is substantially equal to the width of the gap 34 at each point along its length, whereby when the valve is open, the gap 34 substantially disappears.

The application of continued pressure on the tube then results in the contents of the tube being dispensed through the open dispensing slit 22. If the applicator is positioned against the skin of the user and moved, the dispensed material will spread over at least a proportion of the external surface or applicator surface of the applicator 24 and thus be applied in a thin layer to the skin of the user. When the user ceases to apply a pressure to the tube, the resilience of the plates 18 results in their moving back towards one another and the dispensing slit 22 returning to the closed position, whereby the tube is again substantially sealed.

Figure 4:
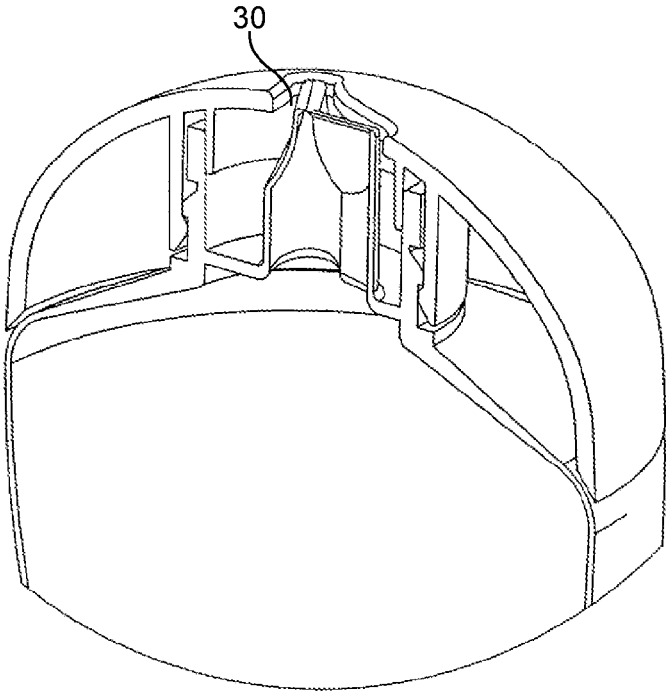
FIG. 4 is a partly cut away view similar to FIG. 2 of the upper portion of a second embodiment of dispenser.
Figure 5:
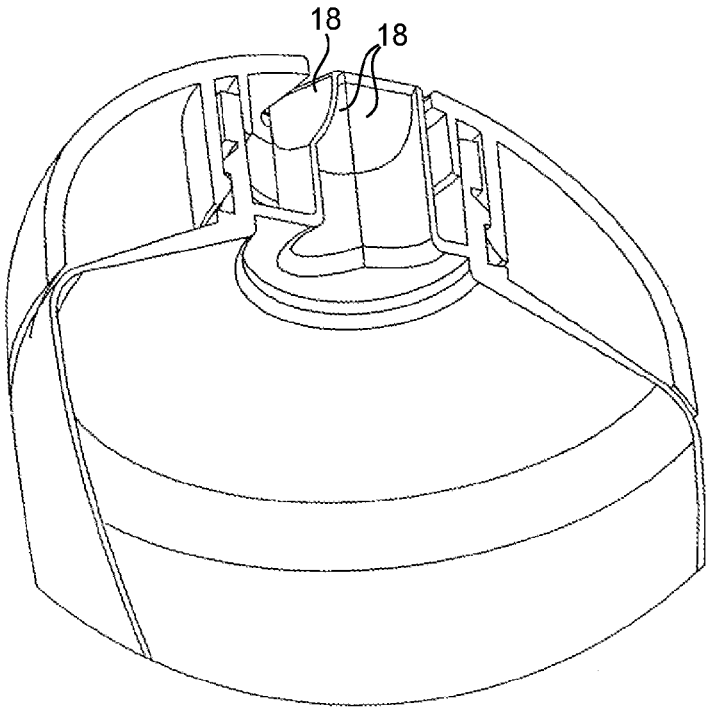
FIG. 5 is a further view of the second embodiment similar to FIG. 4 but in which the dispensing valve has not been cut away.
Figure 6:
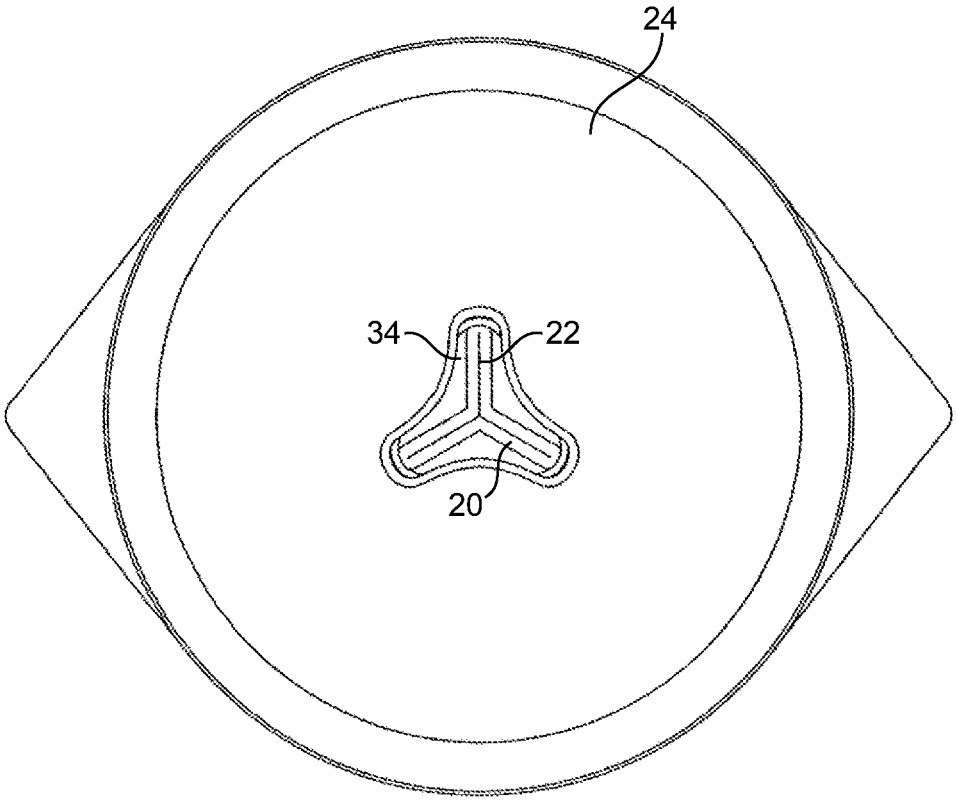
FIG. 6 is a plan view of the dispenser of FIGS. 4 and 5.

The second embodiment of dispenser illustrated in FIGS. 4 to 6 is generally similar to the first embodiment and the same reference numerals are therefore used to designate the same components. The only difference of substance is that instead of a single pair of inclined plates 18, there are three pairs of inclined plates 18, each pair being offset from each adjacent pair by 120°. The lower portion 16 of the dispensing valve merges into the three pairs of inclined plates 18 and each side edge of each inclined plate merges into and is integral with the side edge of the adjacent inclined plate of the adjacent pair of plates. Each pair of plates 18 defines a respective dispensing slit 22 and the three dispensing slits meet on the axis of the tube 2 and the applicator 24. The free upper edges of each pair of plates are therefore connected together in this case at one end only, that is to say at their radially outer end, and are free to move with respect to one another at their radially inner end. The lower edges of each pair of plates merge into a part-elliptical tubular portion, that is to say a tubular portion which is of part-elliptical shape and is open at one end. The three part-elliptical portions merge into one another, whereby the inlet or upstream end of the dispensing valve is of symmetrical, trilobal shape. Formed in the applicator 24 are three passages or slots 30, which communicate with one another at one end and each of which accommodates a respective pair of free upper edges 20 of a pair of inclined plates 18. As may be seen in FIG. 6, the width of each passage 30 increases progressively from its outer end to its inner end, whereby the three passages or slots 30 merge together to form a single aperture whose shape is similar to that of a triangle with concave sides. There is therefore again a gap 34 defined between the outer surface of each inclined plate 18 of each pair of inclined plates and the adjacent side surface of the associated passage or slot 30, the width of which gap 34 increases progressively from its outer end to its inner end. This is shown in FIG. 6 but the size of the gap is again shown on a somewhat exaggerated scale for the sake of clarity. Again, when the valve is opened by the application of pressure to the tube 2, the free upper edges 20 of each pair of inclined plates move apart to open the associated dispensing slit 22 and since the free upper edges 20 are connected together only at their outer ends, the distance by which they move apart increases progressively from the outer end of each pair of free upper edges to their inner end. The components are again dimensioned such that the gap 34 substantially disappears when the valve is fully open, that is to say when the valve is fully open the outer side surfaces of the inclined plates 18 approach or substantially contact the adjacent side surface of the associated passage 30.

It will be appreciated that numerous modifications may be made to the embodiments described above. Thus, for instance, the applicator may have any desired shape as is most appropriate for the particular material that is to be dispensed and, as mentioned above, the applicator surface may be coated or covered with e.g. absorbent or spongy material. The number of pairs of inclined plates and thus of dispensing slits may be varied at will and four sets of plates and four dispensing slits, preferably again equiangularly spaced apart, with a corresponding number of communicating slots or passages in the applicator, would certainly be possible. Indeed, more than four would also be possible but it is thought that in practice little advantage would be obtained by further increasing the number of dispensing slits.

The invention claimed is:

1. A dispenser for viscous or pasty materials comprising:

a storage container in the form of a flexible tube and an applicator, the flexible tube comprising an elongate, one-piece, hollow moulding of polymeric material, one end of which is closed and formed at the other end of which is an integral dispensing valve including a pair of resilient plates which are opposed and inclined to one another, each of the resilient plates having a free edge, the two free edges defining a single, linear dispensing slit, the applicator having an applicator surface and a single elongate passage formed in it in which free ends of the resilient plates are received, the width of the single elongate passage being less at the ends of the passage than at the centre of the passage, whereby the application of pressure to the wall of the tube results in the free edges of the resilient plates moving apart to open the single dispensing slit and abut side surfaces of the passage and, in use, in dispensing of a material through the dispensing slit onto the applicator surface.

2. A dispenser for viscous or pasty materials comprising:

a storage container in the form of a flexible tube and an applicator, the flexible tube comprising an elongate, one-piece, hollow moulding of polymeric material, one end of which is closed and formed at the other end of which is an integral dispensing valve including two or more pairs of opposed resilient plates inclined to one another, the plates of each pair having respective free edges, the two free edges of each pair defining a linear dispensing slit, the two or more dispensing slits being inclined to one another, the applicator having an applicator surface and two or more elongate passages formed in it which communicate with one another at one end, each elongate passage accommodating the free edges of a respective pair of resilient plates, wherein the width of each elongate passage is greater at the said one end than at the other end, whereby the application of pressure to the wall of the tube results in the free edges of each pair of resilient plates moving apart to open the dispensing slits and abutting side surfaces of the associated passage and, in use, in the dispensing of a material through the dispensing slits onto the applicator surface.

3. A dispenser as claimed in claim 1, in which the dispensing valve has two ends, the dispensing slit being formed at one of the ends and the other end being of generally oval tubular shape and communicating with the interior of the flexible tube.

4. A dispenser as claimed in claim 2 in which the dispensing valve has two ends, the dispensing slits being formed at one of the ends, the other end comprising a number of part-oval shaped tubular portions, each associated with a respective one of the dispensing slits, the part-oval shaped portions merging into one another, whereby the other end of the dispensing valve is of multilobal tubular shape.

5. A dispenser as claimed in claim 1 in which the free edges of the or each pair of resilient plates are flush with or set back from the adjacent portions of the applicator surface.

6. A dispenser as claimed in claim 1, in which the applicator is connected to the tube by a snap connection.

7. A dispenser as claimed in claim 6 in which the tube carries a first hollow boss extending around the dispensing valve and the applicator carries a second hollow boss projecting from its surface opposite to the applicator surface, the first and second bosses carrying cooperating formations, whereby the second boss may be pushed around or within the first boss and the cooperating formations interact to lock the applicator to the tube.

8. A dispenser as claimed in claim 1, in which the applicator surface is domed.

9. A dispenser as claimed in claim 2 in which the free edges of each pair of resilient plates are flush with or set back from the adjacent portions of the applicator surface.

10. A dispenser as claimed in claim 2, in which the applicator is connected to the tube by a snap connection.

11. A dispenser as claimed in claim 2, in which the applicator surface is domed.

* * * * *